United States Patent [19]

Kobayashi et al.

[11] Patent Number: 4,660,574

[45] Date of Patent: Apr. 28, 1987

[54] REEL ATTACHING AND DETACHING DEVICE

[75] Inventors: Hideki Kobayashi, Tokyo; Yutaka Okumoto, Musashino; Mikio Komori, Matsudo, all of Japan

[73] Assignee: Japan Tobacco, Inc., Tokyo, Japan

[21] Appl. No.: 701,358

[22] Filed: Feb. 13, 1985

[30] Foreign Application Priority Data

Feb. 15, 1984 [JP] Japan ..... 59-25153

[51] Int. Cl.[4] ..... A24C 5/14

[52] U.S. Cl. ..... 131/105; 131/60

[58] Field of Search ..... 131/105, 60, 81.1, 280

[56] References Cited

U.S. PATENT DOCUMENTS

| | | | |
|---|---|---|---|
| 3,123,268 | 3/1964 | Gagg | 131/60 |
| 4,253,906 | 3/1981 | Boogers | 131/105 |
| 4,262,681 | 4/1981 | Waegaert et al. | 131/105 |

FOREIGN PATENT DOCUMENTS

| | | |
|---|---|---|
| 3124731A1 | 1/1983 | Fed. Rep. of Germany . |
| 2066789A | 7/1981 | United Kingdom . |
| 2093439A | 9/1982 | United Kingdom . |

*Primary Examiner*—V. Millin

*Attorney, Agent, or Firm*—Murray and Whisenhunt

[57] ABSTRACT

A reel attaching and detaching device which is to be employed in a cigarette rolling machine is disclosed. It includes a travelling carrier adapted to travel on a pair of rails extending in parallel relation, a pair of revolvable threaded shafts mounted on the travelling carrier and extending in the normal direction with respect to the rails, a motor mounted on the travelling carrier and adapted to revolve the threaded shafts, a pair of clamps engaged with the threaded shafts and adapted to clamp a reel, the clamps being simultaneously moved outward or inward by the motor, two limit switches, one for setting a waiting position of the clamps in order to clamp the reel from inside and the other for setting a waiting position of the clamps in order to clamp the reel from outside, a box mounted on the travelling carrier in such manner as to move in the transversing direction with respect to the travelling direction of the carrier, and a pusher having a generally H configuration disposed at the front of the box in such a manner as to move transversing the clamps.

6 Claims, 8 Drawing Figures

REEL ATTACHING AND DETACHING DEVICE

BACKGROUND OF THE INVENTION

The present invention relates to a reel attaching and detaching device, and more particularly to a device for attaching and detaching a reel with cigarette rolling paper to a cigarette rolling machine.

One example of such prior art device is given in Japanese Patent Application Laid Open to the Public No. 56(1981)-501829. According to this art, in a travelling carrier adapted to transfer a reel with tobacco rolling paper between a stocker section and a cigarette rolling machine, a pair of clamps are supported by means of function of an air cylinder by admitting a clamp to enter the core cylinder of the reel, and the reel is transferred in this state in order to attach to and detach from a bobbin portion of said rolling machine.

By the way, according to said conventional device, there are such disadvantages that maintenance of a certain degree of air pressure is normally required even in a state where the reel is supported and even a core cylinder of an empty reel is also required to support from inside.

The present invention was accomplished in view of the above described points.

SUMMARY OF THE INVENTION

It is therefore an object of the present invention to provide a reel attaching and detaching device, wherein once a reel is sufficiently clamped by a pair of clamps, no additional power such as an air cylinder as in the case with the prior art is required to maintain such a clamping state of said clamps.

Another object of the present invention is to provide a reel attaching and detaching device, wherein a reel with cigarette rolling paper or rice paper can be clamped with the clamps from the inside as in the case with the prior art and an empty roll can be clamped with the clamps from the outside in order to save time.

In order to achieve the above objects, there is essentially provided a reel attaching and detaching device for detaching an empty reel from a first bobbin of a cigarette rolling machine to discard the same, taking up a loaded reel from a stocker, attaching the loaded reel to said first bobbin, detaching another empty reel from a second bobbin of the cigarette rolling machine to discard the same, taking up another loaded reel from the stocker, and attaching said another loaded reel to said second bobbin, said reel attaching and detaching device comprising a travelling carrier adapted to travel on a track; a pair of revolvable threaded shafts provided on said travelling carrier, said pair of threaded shafts extending substantially in a vertical plane along said track in a straight line; a pair of clamps screwed on said threaded shafts and adapted to hold a reel having a core cylinder by clamping said core cylinder; drive means for driving said pair of threaded shafts such that said pair of clamps move toward and away from each other; support means provided on said carrier for supporting and moving said pair of revolvable threaded shafts by said drive means transversely said track; and a pusher mounted on said travelling carrier and moving perpendicularly across said plane between said pair of clamps to and fro.

DETAILED DESCRIPTION OF THE EMBODIMENT

One preferred embodiment of the present invention incorporated to a device which automatically supplies a reel wound with rice paper (cigarette rolling paper) to a cigarette rolling machine will be described hereunder.

Figure 1:
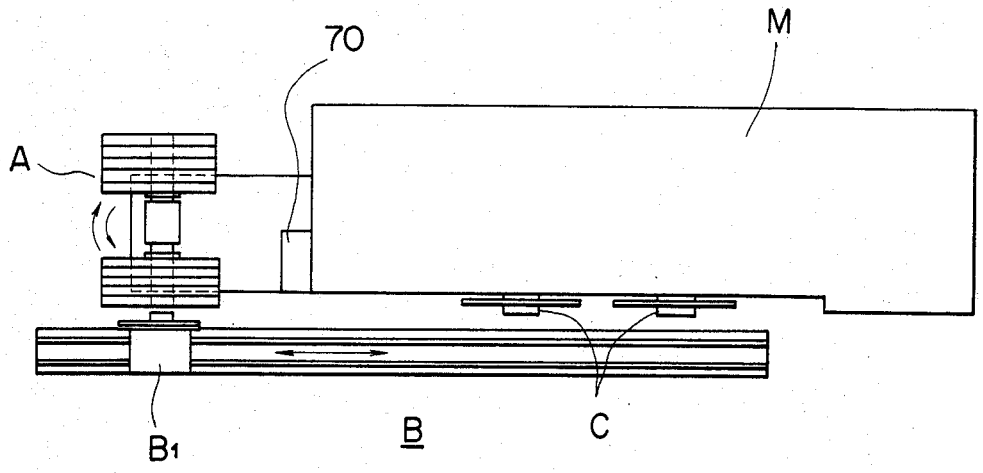
FIG. 1 is a plan view of schematically showing a device for supplying rice paper to a cigarette rolling machine.

Referring to FIG. 1, the automatic supply device according to the present invention comprises a stocker section A positioned on one side of a cigarette rolling machine M, a carrier section B adapted to receive a reel or reels from said stocker section and carry the same over to said cigarette rolling machine, and a bobbin section C adapted to receive the reel or reels from the carrier section B at the cigarette rolling machine M.

After the stocker section A loaded with a plurality of new reels wound with rice paper to supporting frame, it is caused to rotate reversely for intermittently delivering the reels to a waiting travelling carrier B1.

Figure 2:
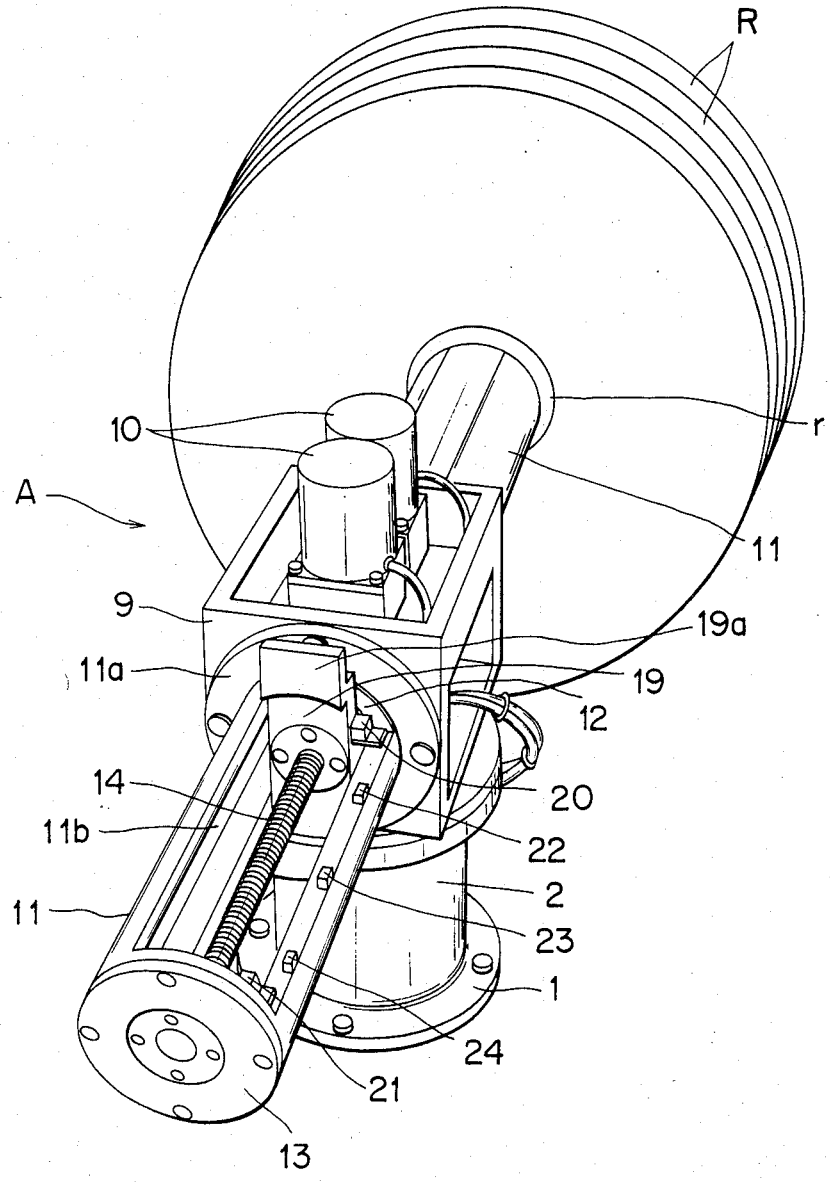
FIG. 2 is a perspective view of a stocker.
Figure 3:
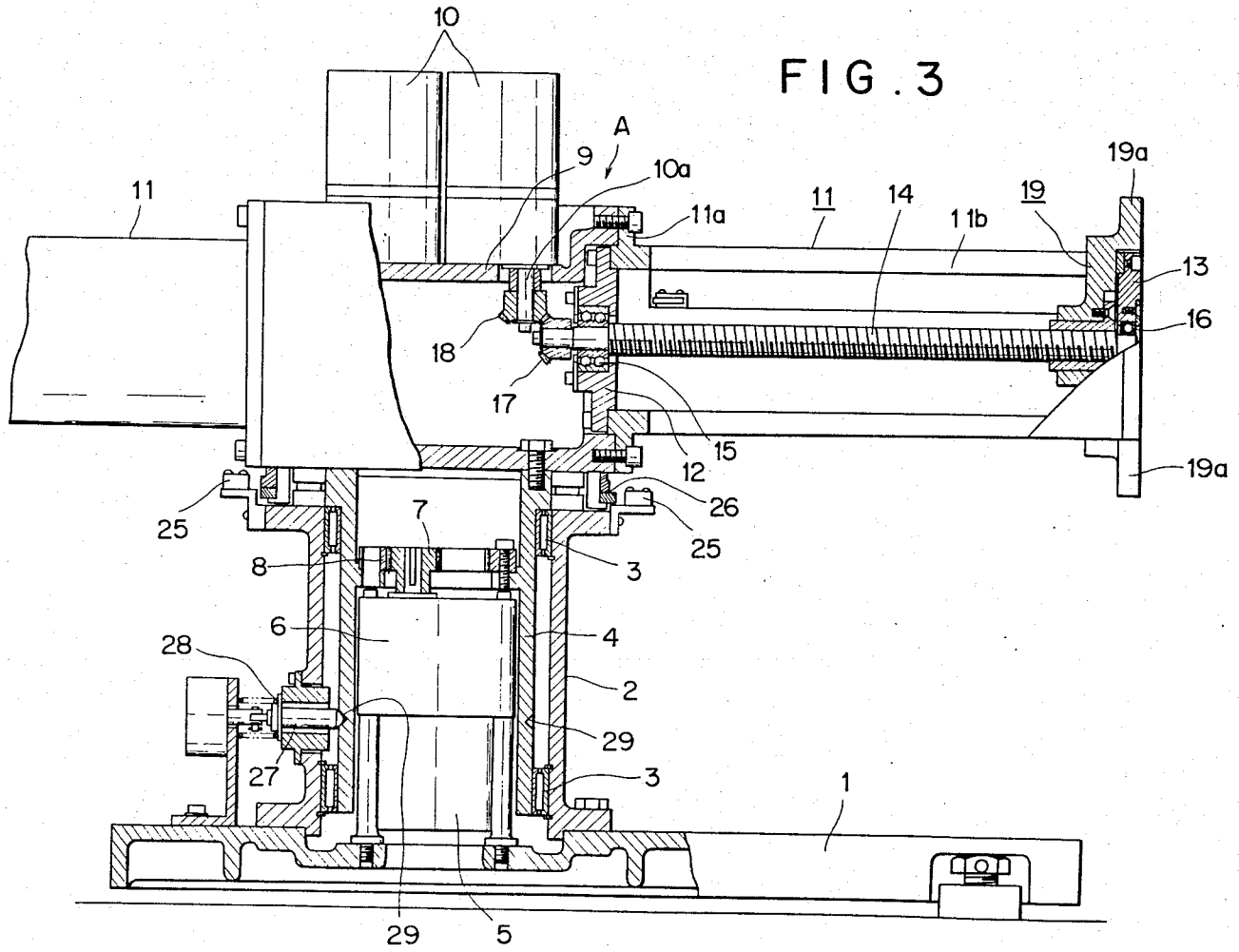
FIG. 3 is a side view, partly in section of the stocker.

Referring to FIG. 2, 1 denotes a stationary base of the stocker portion A. A supporting cylindrical column 2 is erected upright on said base 1. A revolvable cylindrical body 4 is positioned within said supporting cylindrical column 2 through a bearing 3 as shown in FIG. 3. Within said revolvable cylindrical body 4, a motor 5 for reverse rotation and a reduction gear head 6 are mounted on said base 1, and a driving gear 7 thereof meshes with an internal gear 8 firmly fixed within said revolvable cylindrical body 4.

A housing 9 is firmly secured to the upper end of said revolvable cylindrical body 4. Two motors 10, 10 for pushers which will be described later are provided at the upper portion of the housing 9. At the right and left sides thereof, reel support arms in the form of frame structures 11, 11 are firmly secured in symmetric relation with each other through flange portions **11*a*, 11*a* thereof. Shaft supporting plates 12 and 13 are firmly secured to the both end portions of said frame structure 11. A revolvable threaded shaft 14 is disposed intermediate said shaft supporting plates 12 and 13 through bearings 15 and 16. A bevel gear 17 is provided at the internal end of said revolvable threaded shaft 14 and meshed with a bevel gear 18 on a driving shaft 10*a* of the motor 10** for the pusher.

Longitudinally extending guide openings **11*b* are formed in the upper and lower portions of the reel supporting frame structure 11, and a pressure end 19*a* of a pusher 19 screwed on the revolvable threaded shaft 4** extends out of the frame structure through said openings.

Said reel supporting frame structure 11 is provided at its internal and external ends with limit switches 20 and 21 for sensing the retreating and progressing ends of the pusher 10 respectively as shown in FIG. 2. And three pieces of reel sensing limit switches 22, 23 and 24 adapted to sense the number of supporting reels is provided therebetween.

Reverse rotation stopping microswitches 25, 25 are mounted on the upper end and opposite positions of said supporting cylindrical column 2, and on the lower end of the housing 9, a sensing cam 26 is mounted opposite thereto.

In order to establish an appropriate reverse rotation position, a retaining pin 27 is provided at the supporting cylindrical column 2 in a position in agreement with either one of said reverse rotation stopping microswitches 25 in the axial direction and in such a manner as to be biased toward the revolvable cylindrical body 4 by means of a coiled spring 28. In opposite positions of the outer periphery of said revolvable cylindrical body 4, retaining holes 29, 29 adapted to receive therein the retaining pin 27 are formed.

With the above constitution, in the state where the pusher 19 is retreated to the innermost end, a predetermined number of reels R each having a core cylinder r wound with rice paper therearound are engaged to one of the frame structures 11, and said frame structures 11 are rotated by 180 degrees by the reverse rotation motor 5 such that it will be brought to be opposite the carrier section B. With the foregoing state, one of the motors 10 for the pusher 19 is driven to intermittently revolve the revolvable threaded shaft 14 for a predetermined amount and at the same time the pusher 19 is caused to move along the guide openings 11*b*. Then, the reels R wound with rice paper are pushed one by one out to the travelling carrier B1. The rotation of the motor 10 is stopped according to a receiving signal from a sensor 39′ mounted on the pusher 39 carried by the travelling carrier B1 for finishing the reel taking up operation from the stocker.

In the meantime, said reels R are manually loaded on the reel supporting frame structure 11 at the opposite side and caused to rotate reversely as in the same manner as described in the above.

Figure 4:
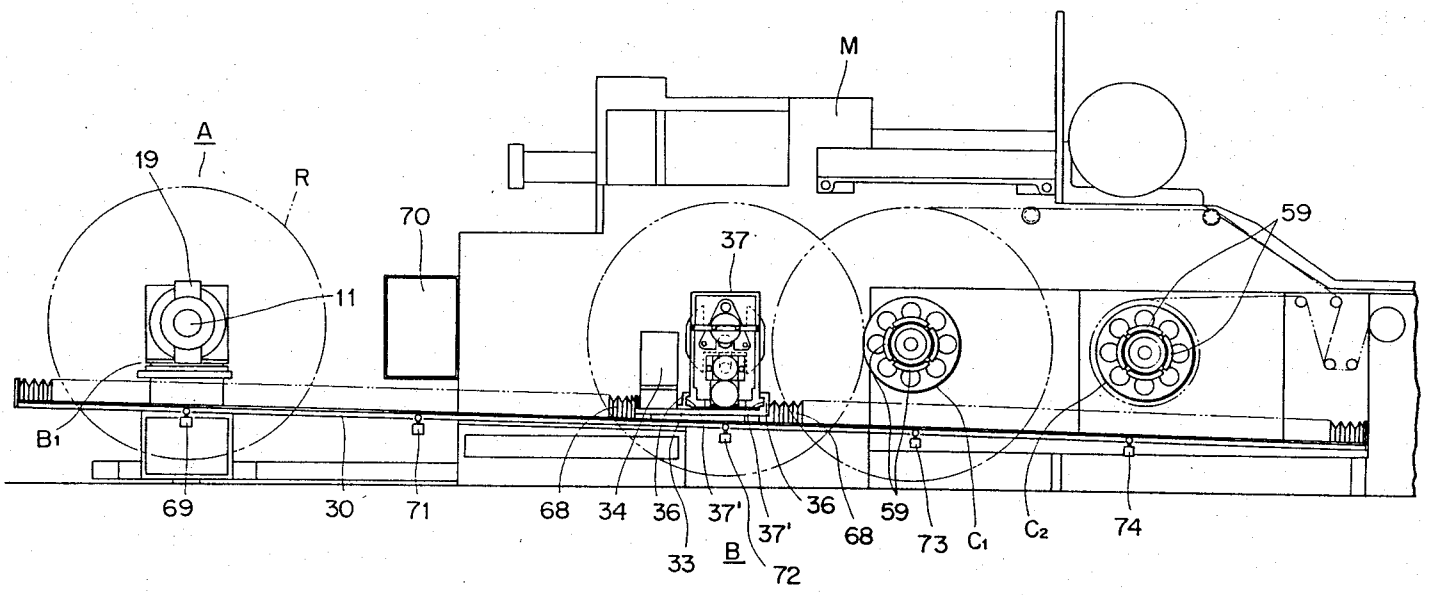
FIG. 4 is a front view of a carrier section.
Figure 5:
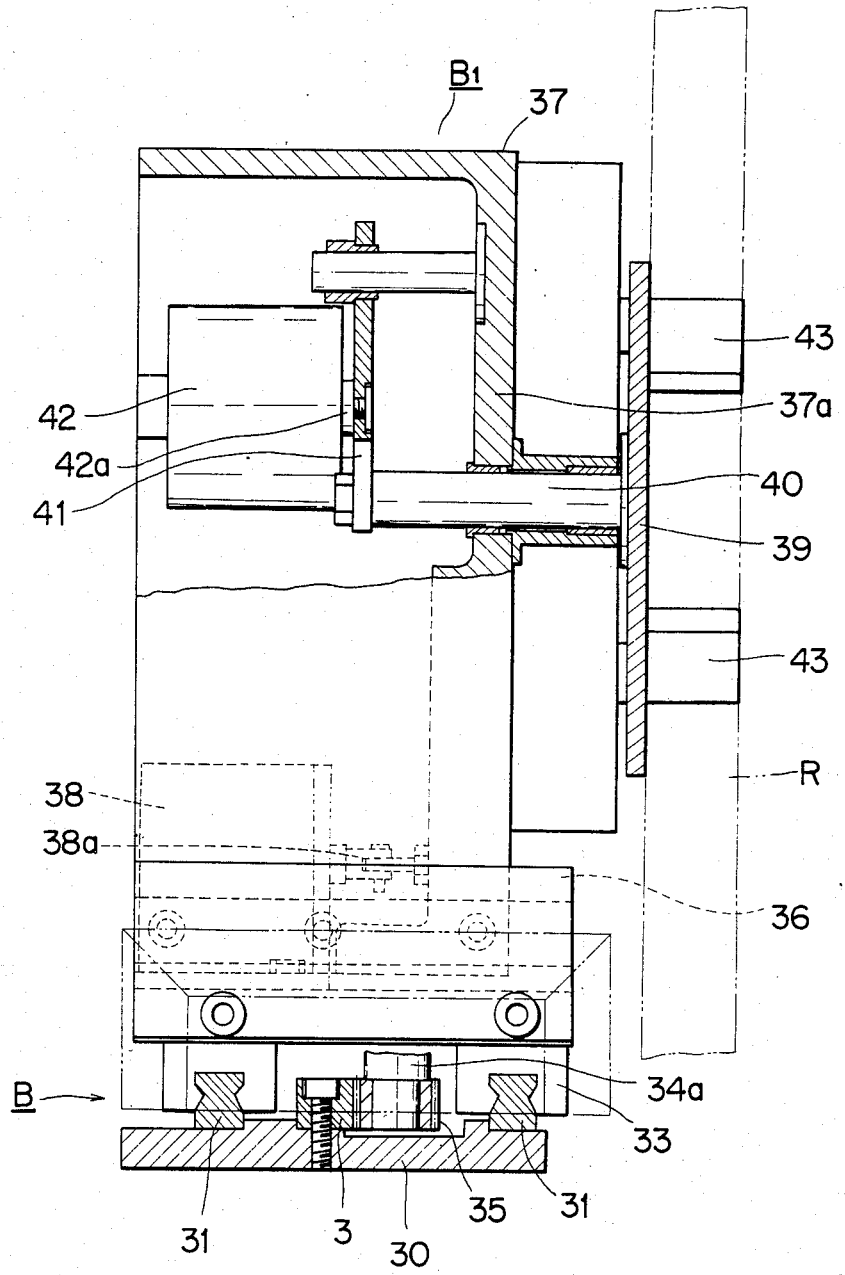
FIG. 5 is a side view, partly in section, of a travelling carrier.

In the carrier B shown in FIG. 4 and sectionally in FIG. 5, a track including two rails 31, 31 are disposed on a base 30, said rails 31, 31 extending from the stocker section A to the bobbin section C of the cigarette rolling machine M. A rack 32 is fixedly provided between said rails 31, 31. A base plate 33 of the travelling carrier B1 is engaged to said rails 31, 31. A pinion 35 mounted on a driving shaft 34*a* of a travelling motor 35 positioned on said base plate 33 is meshed with said rack 32. The travelling carrier B1 is moved along said rails 31, 31 in accordance with the motion of said motor 34.

Another pair of guide rails 36, 36 are firmly secured on said base plate 33 of the travelling carrier B1, said guide rails 36, 36 extending in the transversing direction with respect to the track or the travelling direction of said travelling carrier B1. A box 37 formed on the lower side thereof with a projection 37′ is movably located between the rails 36, 36 with said projection 37′ engaged thereto. An air cylinder 38 is firmly secured to the base plate 33 and its piston 38*a* is connected to said box 37. According to the motion of said air cylinder 38, the box 37 is moved in the transversing direction with respect to the moving direction of the travelling carrier B1.

At the front of said box 37 with respect to the moving direction thereof, a pusher 39 is provided in order to be of help to receive the reels R. Said pusher 39 also serves as a back plate thereof.

Figure 6:
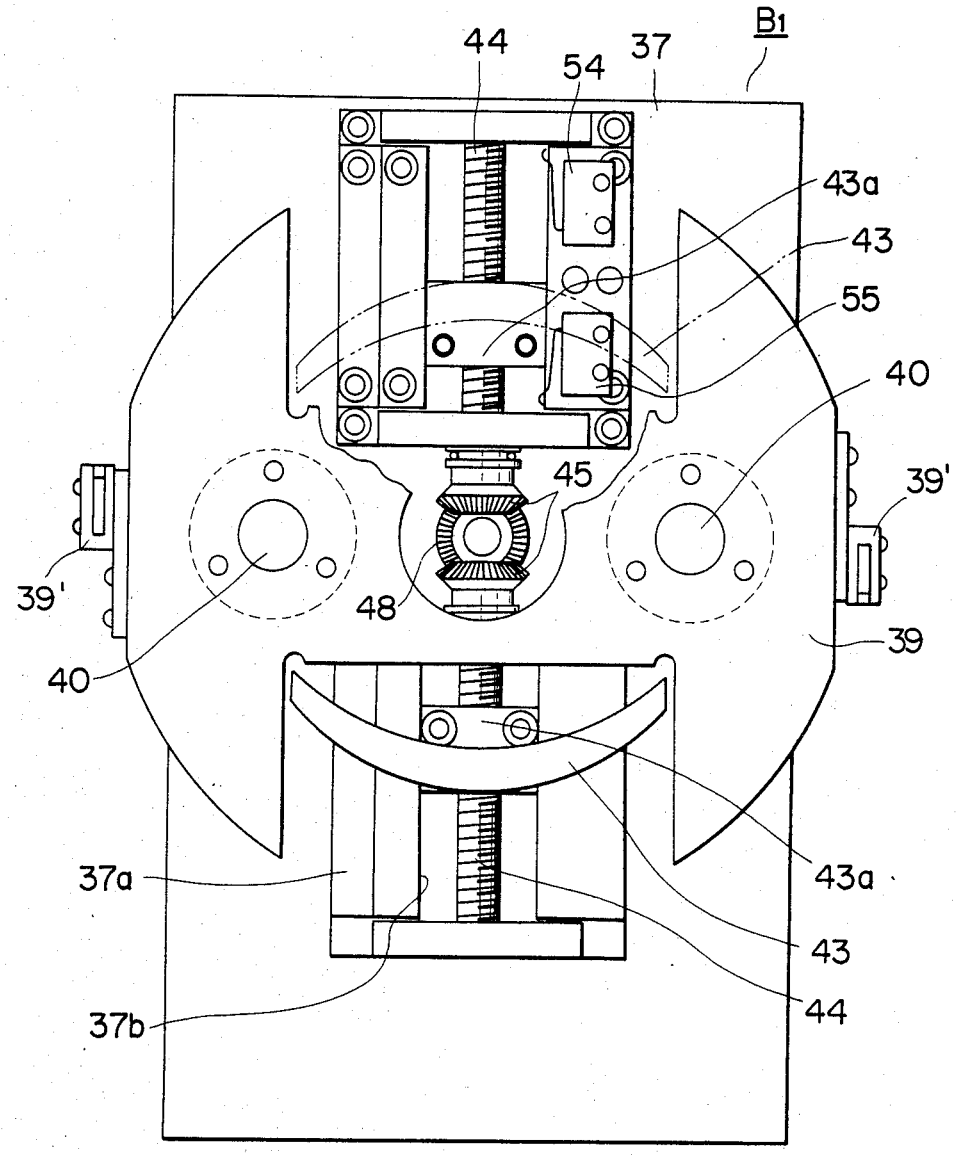
FIG. 6 is a front view of the travelling carrier.

The pusher 39 is firmly secured to the external end of a slide shaft 40 axially movably supported by a partition wall 37*a* of the box 37. A piston 42*a* of an air cylinder 42 is connected to the internal end of said slide shaft 40 through a connection plate 41. As a result, the pusher 39 is caused to move forward or backward by said air cylinder 42. The pusher 39 is cut in a generally H shape so that cut-out portions 39*a*, 39*a* at its upper and lower portions may receive therein clamps 43, 43 in such a manner as to allow the movement thereof as shown in FIG. 6.

The clamps 43, 43 are respectively formed in a shape of an arcuate plate body curving outward so that it will be in accord with the arcuate shape of the core cylinder of said reel R. The mounting base portions 43*a*, 43*a* of said clamps 43, 43 are engaged in a guide groove 37*b* extending in the vertical direction at the front of the partition wall 37*a* of said box 37. Said mounting base portions 43*a*, 43*a* are designed to be movable along said guide groove 37*b* in the vertical direction and threadedly engaged with revolvable threaded shafts 44, 44 extending in the vertical direction within said guide groove 37*b*.

Figure 7:
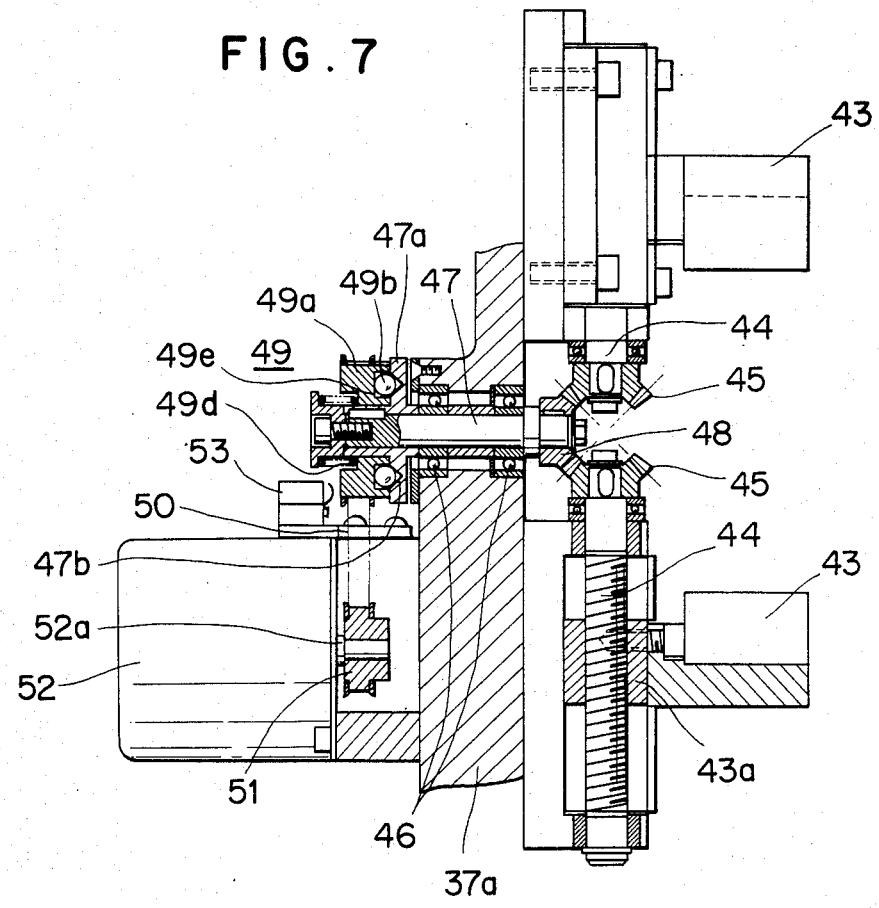
FIG. 7 is a detailed view of a mechanism for actuating the clamps on the travelling carrier.

Referring to FIG. 7, bevel gears 45, 45 are firmly secured to the opposing ends of said revolvable threaded shafts 44, 44 respectively and meshed with a bevel gear 48 mounted on one end of a driving shaft 47 carried by a bearing 46 at the partition wall 37*a*.

At the other end of said driving shaft 47 provided is a clutch mechanism 49 which is driven by a driving shaft 52*a* of a motor 53 through a gear belt pulley 49*a*, a gear belt 50 and a gear belt pulley 51 thereof. The gear belt pulley 49*a* is rotatably mounted on the driving shaft 47 and a ball 49*b* for engaging in a recess 47*b* formed in a flange 47*a* fixed to the driving shaft 47 is held in a chamber 49*c* opposite thereto. Since said gear belt pulley 49*a* is normally urged toward the flange 47*a* by a spring 49*d*, the gear belt pulley 49*a* and the driving shaft 47 are integrally rotated through said ball 49*b*. When the clamps 43, 43 are brought to a predetermined clamping state, the driving shaft 47 becomes unrotatable. As a result, the gear belt pulley 49*a* departs from the flange 47*a* by resisting the force of the spring 49*d* and rotates idly. At this time, a limit switch 53 is actuated by said gear belt pulley 49*a* for stopping the motion of a drive source or a motor 52.

At the side of the guide groove 37*b* formed in the partition wall 37*a*, a limit switch 54 for setting a waiting position for clamping an empty core from outside by said clamps 43, 43 is provided in the external position or upper position, while in the internal position or lower position, another limit switch 55 for setting a waiting position for clamping the reel R with rice paper from inside by the clamps 43, 43 is provided.

Figure 8:
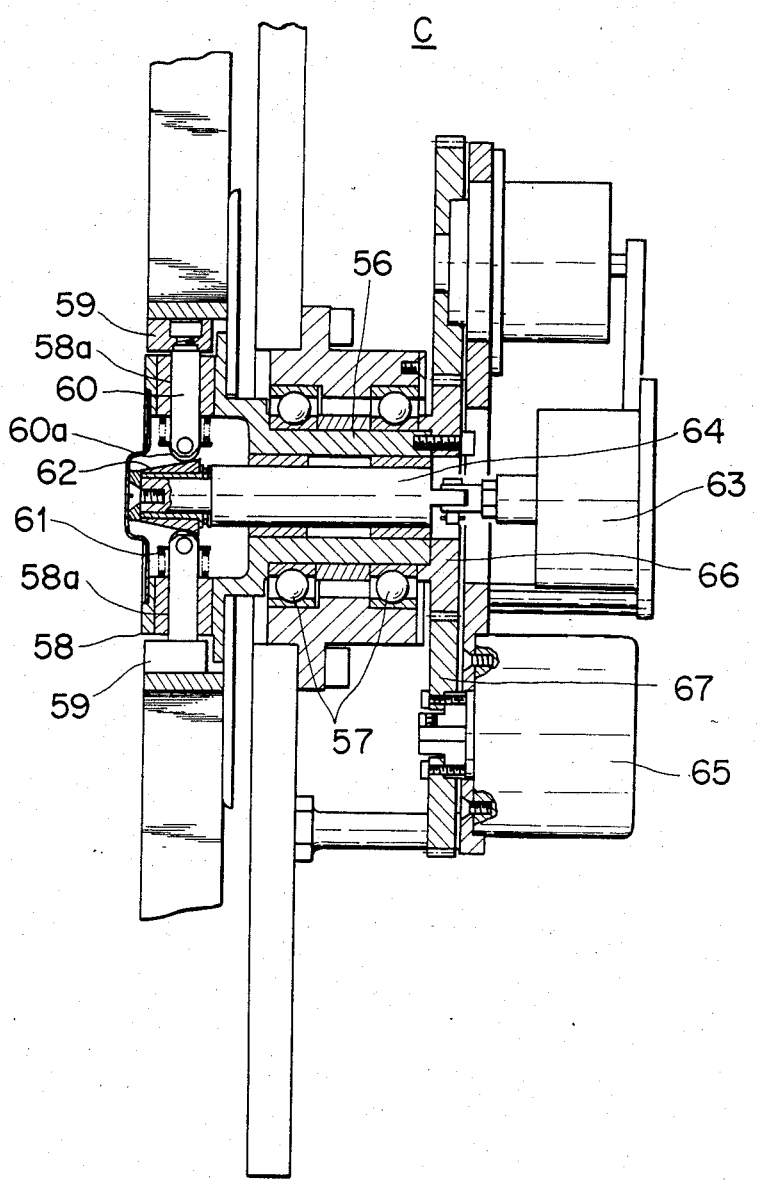
FIG. 8 is a sectional view of a bobbin portion.

At the front of the cigarette rolling machine, the bobbin section C shown in cross-section in FIG. 8, is rotatably carried by a bearing 57 through a shaft section 56. On the outer periphery of a supporting section 58, four pieces of arcuate grippers 59 are firmly secured to the external end of a supporting bar 60 slidably disposed in a hole 58*a* extending in the radial direction of said supporting portion 58 so that said grippers 59 can move in the radial direction. The internal end 60*a* of the supporting bar 60 is abutted against a cam 62 biased by a spring 61. The cam 62 is connected to a slide shaft 64 actuated by an air cylinder 63, and the four pieces of grippers 59 which are in pulled-in positions by normally pulled by the spring 61 are pushed out by the air cylinder 63 at the time when said grippers 59 received the rice paper at the supporting portion 58 and the core of the reel R is clamped from inside.

65 denotes a rotary encoder which associates with the rotation of the bobbin section C through gears 66 and 67. Said rotary encoder 65 transmits a signal according to the number of rotation so that said bobbin section C starts motion for receiving the reel R with rice paper from the travelling carrier B1.

The rails 31, 31 of said carrier section B1 are provided at the both ends thereof with accordion-shaped covers 68, 68 connected to the both sides of the travelling carrier B1 respectively. When travelling, the travelling carrier B1 travels expanding one of the covers 68 and contracting the other.

A plurality of limit switches for instructing stopping positions of the travelling carrier B1 are provided on said base 30. That is, there are provided a sensor 69 positioned opposite the stocker section A for receiving the rice paper, a sensor 71 for sensing a position for detaching an empty core corresponding to an empty core box 70, a sensor 72 for an intermediate waiting position 72, a sensor 73 corresponding to a first bobbin C1, and a sensor 74 corresponding to a second bobbin C2 all arranged in this order from one end of the base 30 to the other.

With the above constitution, in the state where the first and second bobbins C1 and C2 are loaded with the reels R with rice paper, the clamps 43, 43 are moved outward when the travelling carrier B1 is at the intermediate waiting position. Firstly, when the rice paper of the first bobbin C1 is used up, the clamps 43, 43 are moved to the position where the first bobbin is located according to the signal from the rotary encoder 65. After the clamps 43, 43 are positioned outside of an empty core cylinder by the box 37 progressed by the air cylinder 38, they are moved inside by the motor 52. Upon clamping the empty core cylinder r with said clamps 43, 43, the box 37 is caused to retreat. Then, the travelling carrier B1 is travelled to the empty core box 70 for moving the box 37 in the same manner as mentioned before. After the empty core cylinder r is released from clamping by the clamps 43, 43, the pusher 39 is progressed by the air cylinder 42 for discharging the empty core cylinder into the box 70. Thereafter, the travelling carrier B1 travels to the position of the stocker section A. At this time, the clamps 43, 43 are moved in the inside position. In this state, the pusher 39 which also serves as a back plate receives the rice paper reel R pushed from the stocker section A. At the same time, the clamps 43, 43 are moved to clamp the core cylinder r from inside. The, the travelling carrier B1 travels to a position corresponding to the first bobbin C1. After the box 37 is progressed, the pusher 39 is also progressed to push the reel R to the supporting portion of the first bobbin C1 for delivery and the gripper 59 is moved for securing the reel R by the cam 62 according to the operation of the air cylinder 63. Then, in the same state as mentioned before, the travelling carrier B1 stops in the intermediate waiting position and waits for an empty core of the second bobbin C2.

As described in the foregoing, since the present invention comprises a travelling carrier, a pair of revolvable threaded shafts mounted to said carrier and driven by a motor, a pair of clamps threadedly engaged to said revolvable threaded shafts so that the clamps are moved inward or outward simultaneously when the motor is in operation, and limit switches provided at internal and external positions for setting the waiting position of said clamps, the revolvable threaded shafts maintain the clamps in the clamping state thereof. Therefore, no power supply is required for their maintenance. Furthermore, since the core portion of the reel can be clamped from inside and outside, the attaching and detaching operation of the reel can be effected with ease and speedily.

Moreover, since a clutch mechanism is provided intermediate the motor and the revolvable threaded shafts in order to disconnect the clutch when an overload is incurred, the motor can be stopped revolving after the clamps clamped the reel surely.

While only one embodiment of the invention has been shown in detail, it will be understood that the same is for illustration purpose only and is not to be taken as a definition of the invention, reference being had for this purpose to the appended claims.

What is claimed is:

1. A reel attaching and detaching device for detaching an empty reel from a first bobbin of a cigarette rolling machine to discard the same, taking up a loaded reel from a stocker, attaching the loaded reel to said first bobbin, detaching another empty reel from a second bobbin of the cigarette rolling machine to discard the same, taking up another loaded reel from the stocker, and attaching said another loaded reel to said second bobbin, said reel attaching and detaching device comprising a travelling carrier adapted to travel on a track;

a pair of revolvable threaded shafts provided on said travelling carrier, said pair of threaded shafts extending substantially in a vertical plane along said track in a straight line;

a pair of clamps screwed on said threaded shafts and adapted to hold a reel having a core cylinder by clamping said core cylinder;

drive means for driving said pair of threaded shafts such that said pair of clamps move toward and away from each other;

support means provided on said carrier for supporting and moving said pair of revolvable threaded shafts by said drive means transversely said track; and a pusher mounted on said travelling carrier and moving perpendicularly across said plane between said pair of clamps to and fro.

2. A reel attaching and detaching device according to claim 1, wherein said pair of revolvable threaded shaft extends vertically and has opposing axial ends with a spacing therebetween.

3. A reel attaching and detaching device according to claim 2, wherein said drive means includes a pair of a first bevel gears attached to said opposing ends, a second bevel gear in mesh with said pair of first bevel gears, a drive shaft horizontally extending and carrying said second bevel gear at an axial end thereof, a drive source for rotating said drive shaft axially.

4. A reel attaching and detaching device according to claim 1, further including a pair of limit switch means provided in association with said drive means to limit said movement of the clamps within a predetermined range.

5. A reel attaching and detaching device according to claim 3, further including a clutch mechanism provided between said drive shaft and said drive source.

6. A reel attaching and detaching device according to claim 1, wherein said carrier has a sensor mounted thereon to transmit a signal for finishing the reel taking up operation from the stocker.

* * * * *